US005409309A

United States Patent [19]

Giddings et al.

[11] Patent Number: 5,409,309

[45] Date of Patent: Apr. 25, 1995

[54] DISHRACK MOTION CONTROL ARRANGEMENT FOR A DISHWASHER

[75] Inventors: Michael L. Giddings, Battle Creek; Roger J. Bertsch, Lincoln Township, Berrien County, both of Mich.

[73] Assignee: Whirlpool Corporation, Benton Harbor, Mich.

[21] Appl. No.: 47,909

[22] Filed: Apr. 19, 1993

[51] Int. Cl.[6] ..... A47B 88/00; A47B 95/00

[52] U.S. Cl. ..... 312/331; 312/334.4; 312/334.5; 134/201; 211/41

[58] Field of Search ..... 312/228.1, 330.1, 334.4, 312/334.5, 331; 134/201; 211/41

[56] References Cited

U.S. PATENT DOCUMENTS

| | | | |
|---|---|---|---|
| 1,806,174 | 5/1931 | Morin . | |
| 3,323,853 | 6/1967 | Stark | 312/331 |
| 3,736,037 | 5/1973 | Doepke | 312/351 |
| 4,226,490 | 10/1980 | Jenkins et al. | 312/331 |
| 4,324,439 | 4/1982 | Hagen et al. | 312/331 X |
| 4,591,214 | 5/1986 | Reuter et al. | 312/110 |
| 4,615,570 | 10/1986 | Goodman | 312/110 |
| 5,008,779 | 4/1991 | Salmon | 211/41 X |
| 5,115,822 | 5/1992 | Nichols | 134/201 X |
| 5,119,943 | 6/1992 | Hoang | 211/41 |

FOREIGN PATENT DOCUMENTS 0033483 8/1981 European Pat. Off. ..... 312/334.4

*Primary Examiner*—Edward K. Look
*Assistant Examiner*—Hoang Nguyen
*Attorney, Agent, or Firm*—Robert O. Rice; Joel M. Van Winkle

[57] ABSTRACT

A motion control apparatus for stabilizing the motion of a dishrack mounted within a tub of a dishwasher such that yawing of the dishrack relative to the tub during movement of the dishrack in and out of the tub is prevented. The motion control apparatus includes a mounting mechanism for mounting the dishrack within the tub such that the dishrack is supported within the tub and allowed in and out movement within the tub. A torque shaft is rotatably interconnected with the mounting mechanism such that the torque shaft is disposed transversely within the tub, while gear wheels are rigidly interconnected with the torque shaft at the opposite ends of the torque shaft. Gear tracks are provided along a horizontal top inner surface of the tub corresponding to the gear wheels wherein the gear wheels are operatively meshed with the gear tracks during the in and out movement of the dishrack within the tub.

13 Claims, 4 Drawing Sheets

DISHRACK MOTION CONTROL ARRANGEMENT FOR A DISHWASHER

BACKGROUND OF THE INVENTION

1. Field of Invention

This invention relates to dishwashers and in particular to an apparatus for stabilizing a dishrack during in and out movement from within a dishwasher tub wherein the dishrack is disposed.

2. Description of the Prior Art

In a typical front-loading dishwasher, there is provided an upper dishrack which is moveable in and out of the interior of the dishwasher tub in order to enable loading of dishware items into the dishrack. In a conventional form of a dishwasher, the dishrack is provided with simple support wheel assemblies disposed on opposite sides of the dishrack for rolling on a track provided on the sidewall of the dishwasher tub such that the dishrack is supported for movement in and out of the dishwasher tub. Typically, the simple support assemblies for dishracks are configured to allow a predetermined looseness or tolerance both laterally and vertically to ease manufacturing and assembly requirements. Precision mounting components could substantially eliminate such looseness but would be prohibitively expensive. This looseness, however, produces an objectionable sensation of sloppiness during the movement of the dishrack. It is desirable, therefore, to provide a means for preventing the objectionable sensation of sloppiness in moving the dishrack while permitting lateral and vertical looseness in the dishrack support assembly such that manufacturing costs are minimized.

U.S. Pat. No. 3,323,853 discloses a drawer travel guide mechanism for guiding a drawer and preventing yawing of the drawer relative to a cabinet casing when moving in and out thereof. Roller bearings, supported by U-shaped brackets, support the weight of the drawer. A torque rod is provided extending between open center portions of the roller bearings. Pinion gears are secured at either end of the torque rod for engagement with gear racks located on the underside of the drawer. During operation, the drawer moves in and out of the cabinet casing riding on the stationary roller bearings while the torsional interconnection of the pinion gears on the torque rod defeats the tendency of the drawer to skew. This mechanism, while basically achieving an anti-skew effect for a drawer, does not lend itself to a dishrack application because the bottom-mounting of the torque rod is not suitable for an upper dishrack as it would interfere with the cleaning action of the dishwasher spray. Further, the roller bearing support structure is relatively elaborate and costly and would be difficult to maintain in an interior dishwasher environment.

U.S. Pat. No. 4,226,490 discloses a stabilizing arrangement for stabilizing the in and out movement of a dishwasher dishrack including a stabilizer axle mounted to the dishrack and extending normal to the direction of movement of the dishrack. Frictional rollers are fixed at either end of the stabilizer axle, spring biased into engagement with a horizontal top interior surface of the dishwasher cabinet. The constrained simultaneous rotation of each wheel and the spring bias combine to prevent lateral skewing and vertical sloppiness. This stabilizing arrangement, however, is relatively costly and complex and includes a plurality of components in addition to the stabilizer axle and the frictional rollers. Further, this system relies on the frictional engagement of the frictional rollers and the horizontal top interior surface to prevent lateral skewing. It is contemplated by the inventors of the present invention that the presence of a water film or grease residue on the horizontal top surface of the cabinet, as commonly occurs, would substantially reduce the utility of the frictional engagement. Further, the spring bias required in the above described stabilizing arrangement may objectionably increase the force required to move the dishrack in and out of the cabinet.

SUMMARY OF THE INVENTION

The present invention provides a motion control apparatus for stabilizing the motion of a dishrack mounted within a tub of a dishwasher such that yawing of the dishrack relative to the tub during movement of the dishrack in and out of the tub is prevented. The motion control apparatus includes a mounting mechanism for mounting the dishrack within the tub such that the dishrack is supported within the tub and allowed in and out movement within the tub. The present invention further includes a torque shaft rotatably interconnected with the mounting mechanism and disposed transversely within the tub. Gear wheels are rigidly interconnected with the torque shaft at the opposite ends. Gear tracks are longitudinally disposed along a horizontal top inner surface of the tub corresponding to the gear wheels such that the gear wheels are operatively meshed with said gear tracks during the in and out movement of the dishrack within the tub.

Accordingly, an object of the present invention is to provide a simple and reliable motion control apparatus for stabilizing in and out motion of a dishrack mounted within a tub of a dishwasher.

Another object of the present invention is to provide a motion control apparatus for stabilizing the motion of a dishrack which is configured as an extension of the dishrack mounting system such that a plurality of rack configurations may be utilized without affecting the operation of the motion control apparatus.

A still further object of the present invention is to provide a motion control apparatus for stabilizing the motion of a dishrack comprising a gear track and gear wheel mechanism; the gear wheels being interconnected by a torque shaft for equalizing the rate of dishrack travel at opposite sides thereof.

Other objects and advantages of the present invention may become apparent to those skilled in the Art, upon reference to the accompanying description when taken in conjunction with the following drawings.

DETAILED DESCRIPTION

Figure 1:
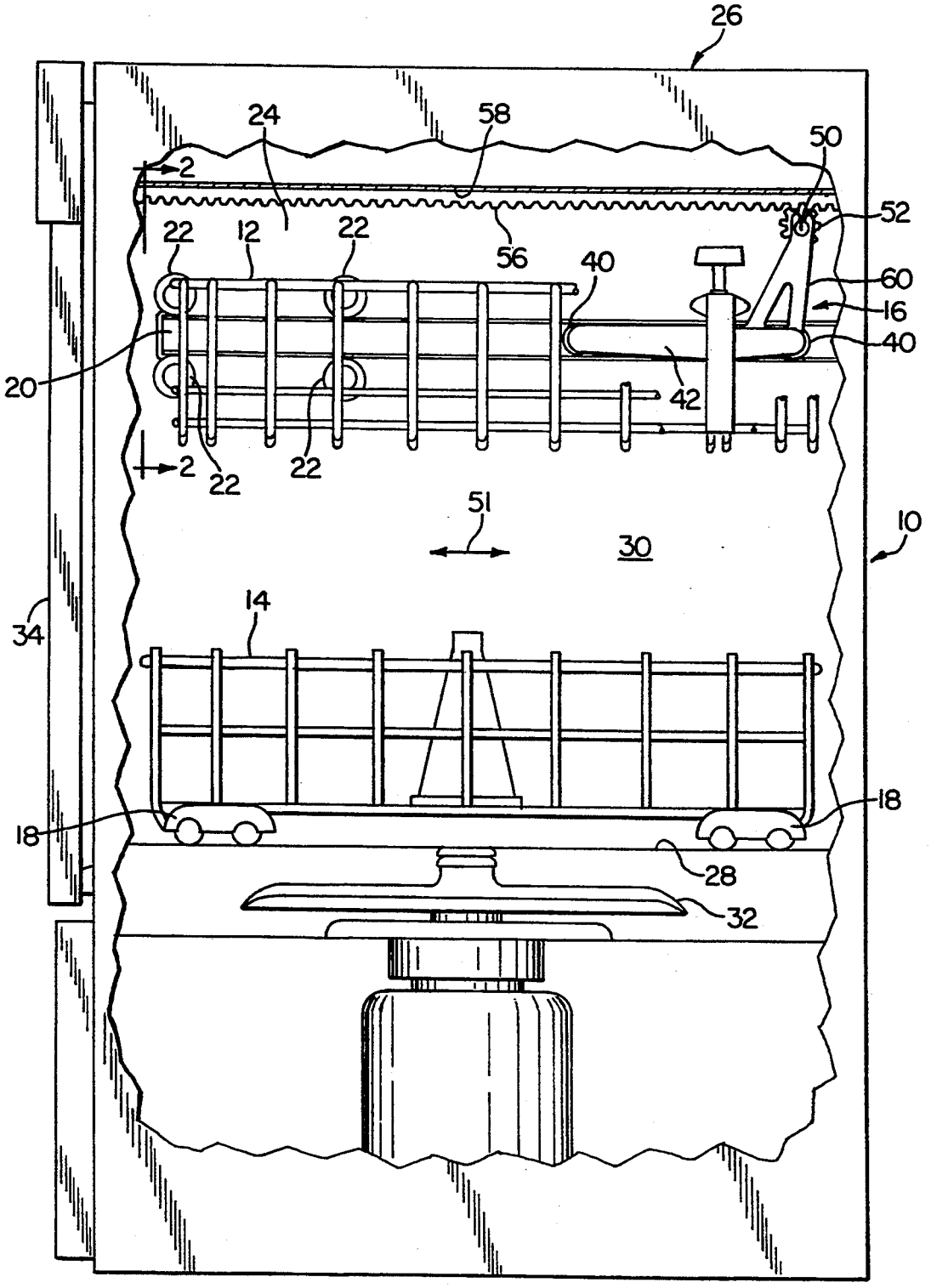
FIG. 1 is a side elevational view in partial section of a dishwasher incorporating a dishwasher rack provided with motion control apparatus according to the present invention.

In the preferred embodiment of the invention as disclosed in FIG. 1, a dishwasher generally designated 10 is provided having a tub 26 which defines a dishwashing cavity 30 in which an upper dishrack 12 and a lower dishrack 14 are moveably mounted. The upper dishrack 12 is provided with a left-hand support wheel assembly generally designated 15 and a right-hand support wheel assembly generally designated 16 (shown in FIG. 2) at opposite sides. The lower rack 14 is provided at its opposite sides with at least two lower wheel assemblies per side generally designated 18. The support assemblies 15 and 16 are received in tracks 20 longitudinally movable between pairs of rollers 22 carried by the sidewall 24 of the dishwasher tub 26. The lower wheel assemblies 18 roll on suitable tracks 28 provided on the sidewalls 24 of the tub 26.

Spray means 32 are provided for spraying dishwashing liquid upwardly against the dishes and the like placed in the racks 12 and 14, respectively. Access to the dishwashing cavity 30 is controlled by a closure door 34 hingedly mounted to the tub 26 to swing downwardly to an open position, wherein the dishracks 12 and 14 may be rolled outwardly for loading and the like.

Figure 2:
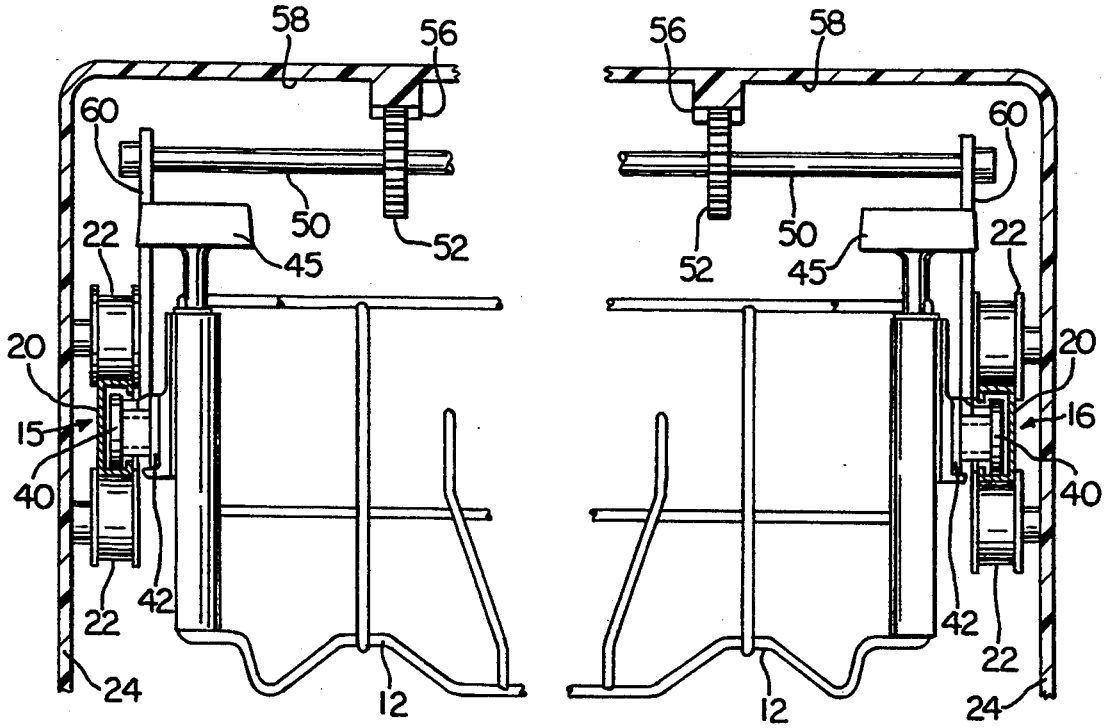
FIG. 2 is an enlarged partially cut away view of the section 2—2 taken in FIG. 1.

Referring now to FIG. 2 in combination with FIG. 1, it can be seen that the wheel support assemblies 15 and 16 include a pair of wheels 40 which are rotatably mounted on an axle protruding from a carrier arm 42. The wheels 40 are received in the tracks 20 for rotatable movement within the tracks 20. Extending from the carrier arm 42 is a vertical extension portion 60.

Rotatably mounted to the vertical extension portion 60 of the carrier arm 42 is a torque shaft 50. The configuration of the vertical extension portion 60 is such that the torque shaft 50 is supported to extend transversely across the upper rear portion of the upper rack 12 so as to be disposed normal to the line of movement 51 (shown in FIG. 1) of the upper rack 12. Rigidly interconnected to opposite ends of the torque shaft 50 are a pair of equal diameter gear wheels 52 having a plurality of teeth 54 (shown in FIG. 3). Corresponding to the gear wheels 52 are a pair of gear tracks 56 longitudinally arranged within the tub 26 and interconnected with the horizontal top inner surface 58 of cavity 30. The vertical extension portion 60, the torque shaft 50, the gear wheels 52 and the gear tracks 56 are proportioned such that the teeth 54 of the gear wheels 52 operatively mesh with the gear tracks 56 during upper dishrack movement. As the dishrack undergoes in and out movement within the tub 26, the torsional interconnection of the gear wheels 52 cause the dishrack travel at opposite sides of the dishrack to be equal. This equalization of the dishrack travel prevents the above described undesirable yawing of the dishrack relative to the tub 26.

The inventors contemplate that in the present invention, the tub 26 will be formed from a thermoplastic resin and that a tub mold will be configured to provide the gear tracks 56 as an integral portion of the tub 26. However, the gear tracks 56 may be support elements fastened to the horizontal top inner surface 58.

Figure 3:
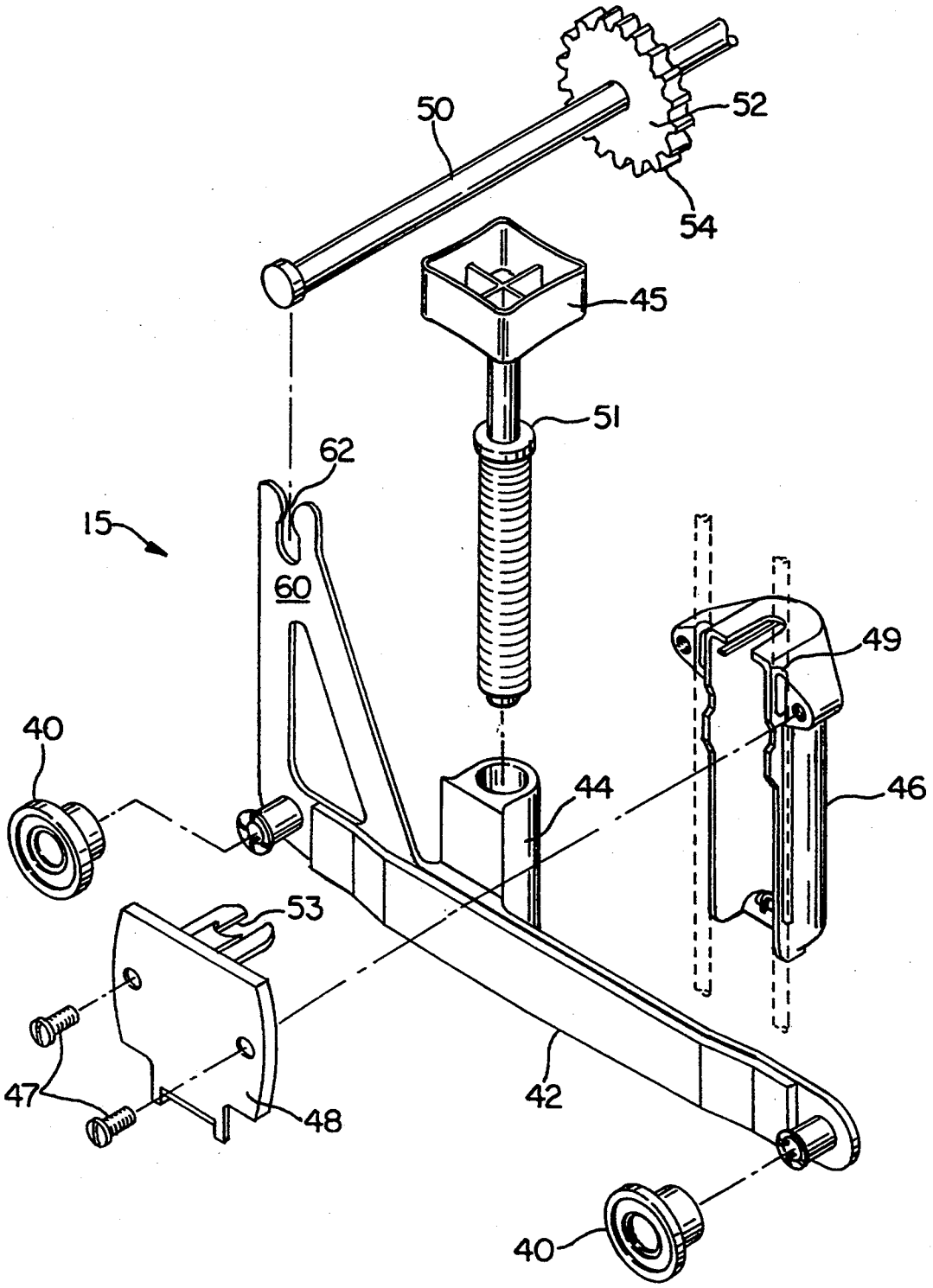
FIG. 3 is an exploded perspective view of the components for the motion control apparatus according to the preferred embodiment of the present invention.
Figure 7:
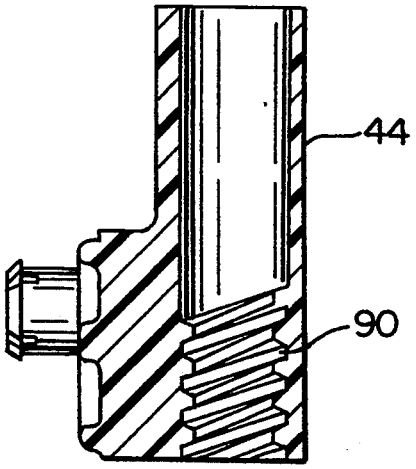
FIG. 7 is an enlarged sectional view thru the adjuster arm taken along line 7—7 of FIG. 4.

Referring now to FIG. 3, the left-hand support wheel assembly 15 is shown in further detail. In the preferred embodiment, the support wheel assemblies 15 and 16 provide a vertical adjustment feature for the upper dishrack 12 such that the upper dishrack 12 may be vertically adjusted in an infinite variety of positions within a predetermined range. The carrier arm 42 of the support wheel assembly 15, therefore, includes a center portion 44 which further includes an internally threaded portion 90, shown in FIG. 7, for receiving a threaded adjuster knob 45. An adjuster housing 46 is provided for receiving the center portion 44 of the carrier arm 42 with the adjuster knob 45 threaded into the center portion 44. Threaded fasteners 47 are provided for securely fastening a mounting plate 48 to the adjuster housing 46 such that dishrack wires, shown in phantom, are captured within the slots 49 between the mounting plate 48 and the adjuster housing 46. The mounting plate 48 further secures the threaded adjusting knob 45, threaded into the carrier arm 42, within the housing 46. A prong portion 53 of the mounting plate 48 inserts above a bearing surface 51 of the adjuster knob 45. In operation, the adjuster knob 45 may rotate within the adjuster housing 46 causing the internally threaded portion 90 of the carrier arm 42 to ride up or down along the threaded portion of the adjuster knob 45. The adjuster housing 46 is fixed relative to the upper dishrack 12 such that the carrier arm 42 may move up and down relative to the upper dishrack 12. In this fashion, therefore, when the carrier arm 42 is fixed relative to the wash tub 26 by means of the wheels 40 being received in the tracks 20, rotation of the adjuster knob 45 causes the dishrack 12 to move up or down.

Still looking at FIG. 3, it can be seen that the vertical extension portion 60 of the carrier arm 42 includes a snap-receiving portion 62 for rotatably capturing the torque shaft 50. The torque shaft 50 is therefore rotatably supported transversely within the wash tub 26 such that gear wheels 52 may mesh with the gear track 56. However, some variation in spacing between the gear wheels 52 and the gear track 56 is anticipated. Therefore, the teeth 54 of the gear wheels 52 are configured to provide engagement with the gear track 56 within a predetermined range of distance between the gear track 56 and the gear wheel 52. This allows acceptable meshing between the gear wheels 52 and the gear track 56 in the presence of manufacturing variances in the fabrication of the dishwasher tub 26 and wheel assemblies 15, 16. The present invention contemplates teeth having a height of 6 mm on the gear wheel and gear track to adequately provide acceptable engagement over a range of separation distances between the gear wheels 52 and the gear tracks 56.

Figure 4:
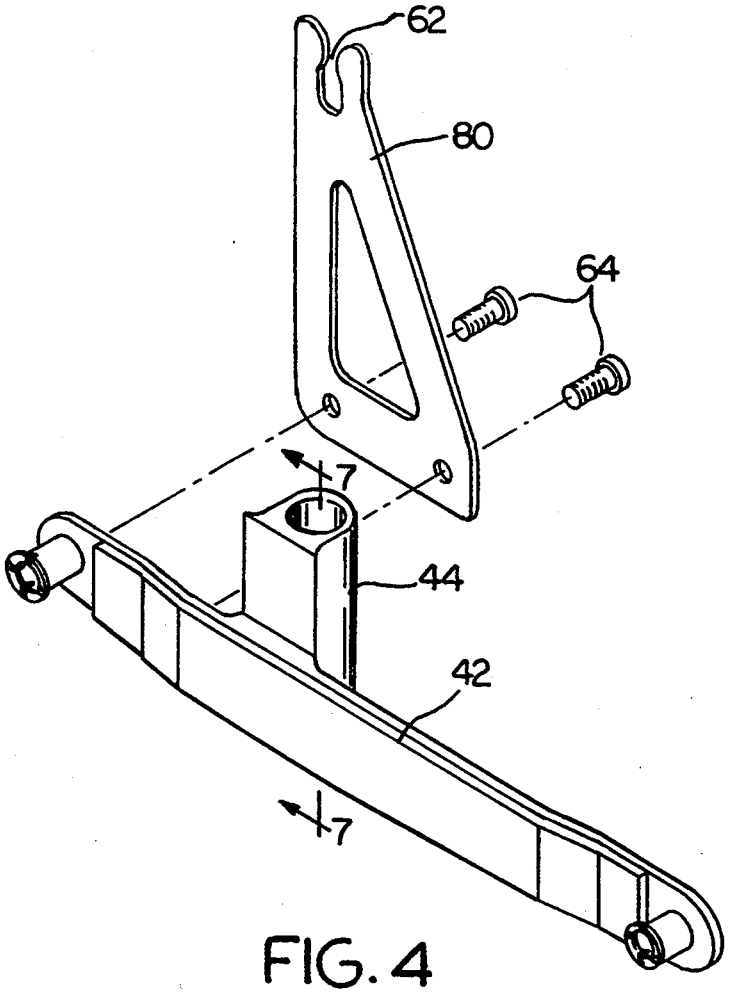
FIG. 4 is an enlarged exploded perspective view of an alternate configuration of the adjuster arm component of the present invention.

Alternate constructions of the carrier arm 42 are contemplated by the inventors. In FIG. 3, the vertical extension portion 60 is shown as an integral extension of the carrier arm 42 as has been described above. In this configuration, the vertical extension portion 60 and carrier arm 42 are formed as one part. In FIG. 4, an alternative construction is shown wherein an alternate vertical extension member 80 is shown as a separate component which may be rigidly interconnected to the carrier arm 42 with a plurality of threaded fasteners 64.

Figure 5:
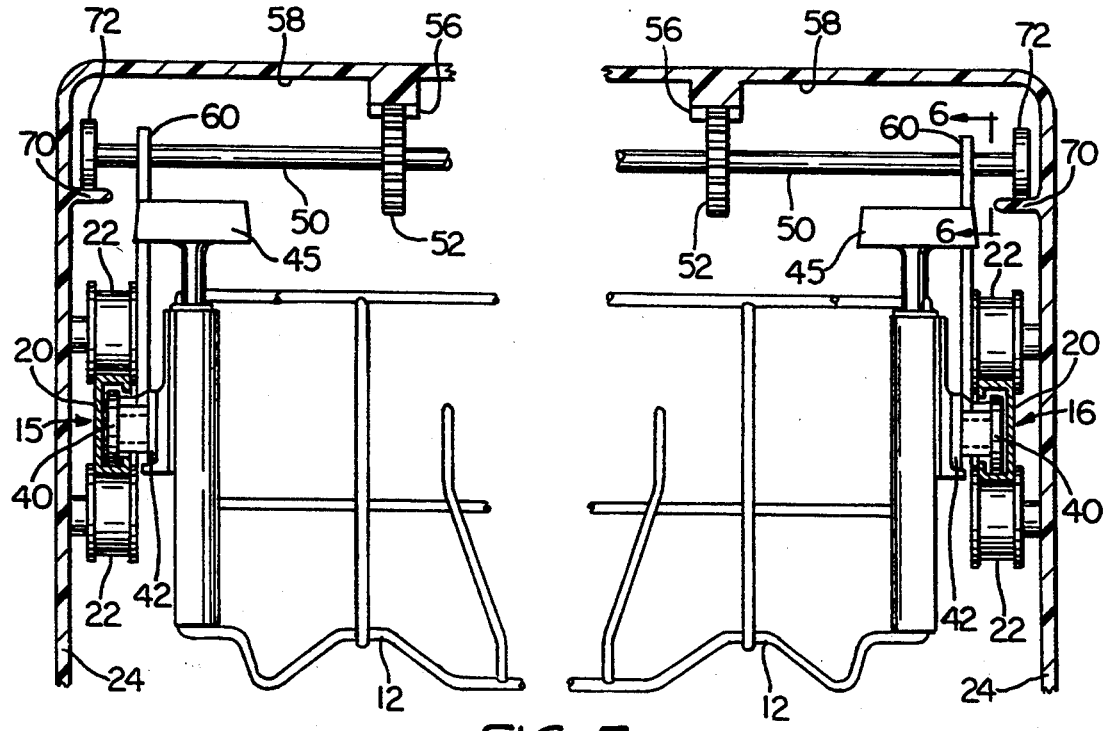
FIG. 5 is an enlarged view of an alternate configuration of the present invention taken along line 2—2 of FIG. 1.
Figure 6:
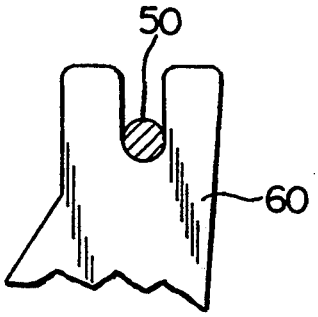
FIG. 6 is a view of the section 6—6 taken in FIG. 5.

FIG. 5 illustrates an alternate configuration of the present invention to control the meshing engagement of the gear wheel 52 and the gear track 56. In this configuration, a pair of longitudinal ribs 70 are provided, extending from the tub vertical side wall 24, disposed near the intersection of the vertical side wall 24 and the horizontal top inner wall 58. A disk 72 is provided at the ends of the torque shaft 50 for rolling engagement with the longitudinal ribs 70 such that upon rolling engagement of the disks 72 with the longitudinal ribs 70, the gear wheels 52 and the gear track 56 are operatively meshed. The interaction of longitudinal ribs 70 and disk 72 therefore, fix the vertical position of the torque shaft 50. Further, FIG. 6 illustrates an alternate interconnection of the vertical extension portion 60 with the torque shaft 50 wherein the wheel assemblies 15, 16 are allowed to move relative to the vertical position of the torque shaft 50. Accordingly, therefore, tolerances associated with the vertical position of the wheel assemblies 15, 16 do not affect the engagement of the gear wheels 52 and the gear track 56.

In this fashion, therefore, a novel apparatus for stabilizing the movement of an upper dishrack in a dishwasher is provided. More specifically, a simple and improved system is provided wherein dishrack yaw relative to the dishwasher tub is prevented.

Although the present invention has been described with reference to a specific embodiment, those of skill in the Art will recognize that changes may be made thereto without departing from the scope and spirit of the invention as set forth in the appended claims.

We claim:

1. A motion control apparatus for stabilizing the motion of a dishrack mounted within a cavity formed by a tub of a dishwasher wherein said tub has a horizontal top inner surface, said apparatus preventing yawing of said dishrack relative to said tub during horizontal movement of said dishrack in and out of said tub, said motion control apparatus comprising:

a torque shaft disposed transversely within said tub;

a plurality of gear wheels rigidly interconnected with said torque shaft for rotating together;

a pair of gear tracks interconnected with said horizontal top inner surface of said tub, said gear tracks extending in the direction of dishrack movement within said tub;

mounting means for supporting said dishrack within said cavity of said tub such that said dishrack is supported within said tub and allowed in and out movement within said tub; and means for rotatably interconnecting said torque shaft with said dishrack within said tub such that said gear wheels are operatively meshed with said gear tracks during said in and out movement of said dishrack within said tub.

2. A motion control apparatus according to claim 1 wherein said plurality of gear wheels further comprise:

a pair of gear wheels keyed to opposite ends of said torque shaft.

3. A motion control apparatus according to claim 1 wherein said mounting means further comprise:

a plurality of rollers rotatably interconnected with said tub;

a pair of tracks disposed between said rollers and supported by said rollers for longitudinal movement;

a carrier arm having a plurality of wheels rotatably interconnected with said carrier arm and being received in said tracks, said carrier arm further having a center portion having an internally threaded portion;

a threaded adjuster knob for threaded engagement with said internally threaded portion of said carrier arm;

an adjuster housing for receiving said center portion of said carrier arm with said adjuster knob threaded into said center portion; and a mounting plate having means for interconnection with said adjustor housing such that said adjustor housing, said carrier arm and said adjustor knob are interconnected with said dishrack and said carrier arm is vertically movable in relation to said dishrack.

4. A motion control apparatus according to claim 3, further comprising:

a vertical extension portion having means for interconnection with said carrier arm and further having means for rotatably supporting said torque shaft.

5. A motion control apparatus according to claim 1, wherein said gear wheels and said gear tracks have teeth of a given height for operatively meshing with each other such that the presence of substantial variance in the vertical position of said gear tracks relative to said gear wheels does not cause disengagement between said gear wheels and said gear tracks.

6. A motion control apparatus according to claim 1 wherein said tub further includes opposite vertical inner surfaces and said horizontal top inner surface, said motion control apparatus further comprising:

a pair of ribs integral with said vertical inner surfaces and extending substantially perpendicular from said vertical inner surfaces of said tub opposite of each other into said cavity of said tub, said ribs being further disposed near the intersection of said horizontal top inner surface and said vertical inner surfaces;

said torque shaft extending above said pair of ribs such that said torque shaft is in rolling engagement with said ribs, and said gear wheels and said gear tracks being proportioned such that upon said torque shaft rollingly engaging said ribs, said gear wheels and said gear tracks are operatively meshed; and said means for rotatably interconnecting said torque shaft with said means for supporting said dishrack further includes means for preventing horizontal movement but allowing vertical movement between said dishrack and said torque shaft such that variance in the vertical position of said gear tracks relative to said mounting means does not cause disengagement between said gear wheels and said gear tracks.

7. A motion control apparatus for stabilizing the motion of a dishrack mounted within a cavity formed by a tub of a dishwasher, said apparatus preventing yawing of said dishrack relative to said tub during horizontal movement of said dishrack in and out of said tub, said motion control apparatus comprising:

a torque shaft disposed transversely within said tub;

a pair of gear wheels keyed to opposite ends of said torque shaft for rotating together;

a pair of gear tracks integrally formed into a top inner surface of said tub and extending in the direction of dishrack movement within said tub;

mounting means for supporting said dishrack within said cavity of said tub such that said dishrack is supported within said tub and allowed in and out movement within said tub, said mounting means further including means for rotabably supporting said torque shaft such that said gear wheels are operatively meshed with said gear tracks during said in and out movement of said dishrack within said tub.

8. A motion control apparatus according to claim 7 wherein said means for mounting said dishrack within said tub further comprises:

A plurality of rollers rotatably interconnected with a said tub;

a pair of tracks disposed between said rollers and supported by said rollers for longitudinal movement; and a carrier arm having a plurality of wheels rotatably interconnected with said carrier arm, said wheels being received in said tracks, said carrier arm supporting said dishrack within said tub: and a vertical extension portion extending from said carrier arm supporting rotatably supporting said torque shaft.

9. A motion control apparatus according to claim 7, wherein said gear wheels and said gear tracks have teeth of sufficient height for operatively meshing with each other such that the presence of substantial variance in the vertical position of said gear tracks relative to said gear wheels does not cause disengagement between said gear wheels and said gear tracks.

10. A motion control apparatus according to claim 7 wherein said tub further includes opposite vertical inner surfaces and said horizontal top inner surface, said motion control apparatus further comprising:

a pair of ribs integral with said vertical inner surfaces and extending substantially perpendicular from said vertical inner surfaces of said tub opposite of each other into said cavity of said tub, said ribs being further disposed near the intersection of said horizontal top inner surface and said vertical inner surfaces;

said torque shaft extending above said pair of ribs such that said torque shaft is in rolling engagement with said ribs, and said gear wheels and said gear tracks being proportioned such that upon said torque shaft rollingly engaging said ribs, said gear wheels and said gear tracks are operatively meshed; and said means for rotatably interconnecting said torque shaft with said means for supporting said dishrack further includes means allowing vertical movement between said dishrack and said torque shaft such that variance in the vertical position of said gear tracks relative to said mounting means does not cause disengagement between said gear wheels and said gear tracks.

11. A motion control apparatus for stabilizing the motion of a dishrack mounted within a cavity formed by a tub of a dishwasher, said apparatus preventing yawing of said dishrack relative to said tub during horizontal movement of said dishrack in and out of said tub, said motion control apparatus comprising:

a torque shaft disposed transversely within said tub;

a plurality of gear wheels rigidly interconnected with said torque shaft for rotating together;

a plurality of gear tracks interconnected with said tub; and mounting means for supporting said dishrack within said cavity of said tub such that said dishrack is supported within said tub and allowed in and out movement within said tub, said mounting means further having a vertical extension portion for rotatably supporting said torque shaft such that said gear wheels are operatively meshed with said gear tracks during said in and out movement of said dishrack within said tub, said mounting means further including:

a plurality of rollers rotatably interconnected with said tub;

a pair of tracks disposed between said rollers and supported by said rollers for longitudinal movement; and a carrier arm having a plurality of wheels rotatably interconnected with said carrier arm, said wheels being received in said tracks such that said carrier arm moveably supports said dishrack within said tub, said vertical extension portion extending from said carrier arm.

12. The motion control apparatus according to claim 11 wherein said mounting means further comprises:

said carrier arm further having a center portion having an internally threaded portion;

a threaded adjuster knob for threaded engagement with said internally threaded portion of said carrier arm;

an adjuster housing for receiving said center portion of said carrier arm with said adjuster knob threaded into said center portion; and a mounting plate having means for interconnection with said adjuster housing such that said adjuster housing, said carrier arm and said adjuster knob are interconnected with said dishrack and said carrier arm is vertically moveable in relation to said dishrack.

13. The motion control apparatus according to claim 8 wherein said mounting means further comprising:

said carrier arm further having a center portion having an internally threaded portion;

a threaded adjuster knob for threaded engagement with said internally threaded portion of said carrier arm;

an adjuster housing for receiving said center portion of said carrier arm with said adjuster knob threaded into said center portion; and a mounting plate having means for interconnection with said adjuster housing such that said adjuster housing such that said adjuster housing, said carrier arm and said adjuster knob are interconnected with said dishrack and said carrier arm is vertically movable in relation to said dishrack.

* * * * *